US011982085B2

(12) United States Patent
Boo

(10) Patent No.: US 11,982,085 B2
(45) Date of Patent: May 14, 2024

(54) BUILDING PANEL WITH LOCKING SYSTEM

(71) Applicant: Välinge Innovation AB, Viken (SE)

(72) Inventor: Christian Boo, Kågeröd (SE)

(73) Assignee: Välinge Innovation AB, Viken (SE)

( * ) Notice: Subject to any disclaimer, the term of this patent is extended or adjusted under 35 U.S.C. 154(b) by 0 days.

(21) Appl. No.: 17/505,229

(22) Filed: Oct. 19, 2021

(65) Prior Publication Data

US 2022/0127850 A1 Apr. 28, 2022

(30) Foreign Application Priority Data

Oct. 23, 2020 (SE) ..... 2051244-8
Jun. 29, 2021 (SE) ..... 2150834-6

(51) Int. Cl.
*E04F 15/02* (2006.01)
*E04C 2/00* (2006.01)

(52) U.S. Cl.
CPC ..... *E04C 2/00* (2013.01); *E04C 2002/001* (2013.01); *E04F 15/02038* (2013.01);
(Continued)

(58) Field of Classification Search
CPC ..... E04C 2/00; E04C 2002/001; E04F 15/02038; E04F 2201/0146;
(Continued)

(56) References Cited

U.S. PATENT DOCUMENTS 7,584,583 B2 * 9/2009 Bergelin ..... E04C 2/24 52/177
7,617,651 B2 * 11/2009 Grafenauer ..... E04F 15/02 52/592.1

(Continued)

FOREIGN PATENT DOCUMENTS

WO WO-2010108980 A1 * 9/2010 ..... E04F 15/02038
WO WO 2013/151493 A1 10/2013

OTHER PUBLICATIONS

U.S. Appl. No. 16/738,602, filed Jan. 9, 2020, Roger Ylikangas, Anders Nilsson and Karl Quist (Cited herein as US Patent Application Publication No. 2021/0087827 A1 of Mar. 25, 2021).

(Continued)

*Primary Examiner* — Brent W Herring
(74) *Attorney, Agent, or Firm* — Boone IP Law

(57) ABSTRACT

A set of building panels including a first mechanical locking system at respective first and second opposite edges. The first mechanical locking system including at one of the first or second opposite edges a tongue groove configured to receive a locking tongue of the other of the first or second edges, for vertical locking of adjacent essentially identical panels in an assembled position. The locking tongue includes an essentially horizontal and/or upwards-facing upper surface. A second mechanical locking system is formed on respective third and fourth opposite edges. The second mechanical locking system includes at one of the third or fourth edges a wedge groove configured to receive a displaceable locking tongue, for vertical locking of essentially identical adjacent panels in an assembled position. The displaceable locking tongue is configured to displace in a displacement groove provided in the said other of the third or fourth edge.

15 Claims, 5 Drawing Sheets

(52) U.S. Cl.
CPC ..... *E04F 2201/0146* (2013.01); *E04F 2201/0535* (2013.01)

(58) Field of Classification Search
CPC . E04F 2201/0535; E04F 13/10; E04F 15/102; E04F 15/107; E04F 2201/0169; E04F 2201/0547; E04F 2201/0153; E04F 2201/0523; E04F 2201/0115; E04F 2201/0552; E04F 2201/0176; E04F 2201/044
USPC ..... 52/582.1, 582.2, 586.1
See application file for complete search history.

(56) References Cited

U.S. PATENT DOCUMENTS

| | | | | |
|---|---|---|---|---|
| 8,511,031 | B2 * | 8/2013 | Bergelin | E04F 15/02016 52/592.1 |
| 8,869,485 | B2 * | 10/2014 | Pervan | E04F 15/02038 52/592.1 |
| 9,458,634 | B2 * | 10/2016 | Derelov | E04F 15/02038 |
| 9,816,270 | B2 * | 11/2017 | Pervan | B27F 1/02 |
| 10,246,883 | B2 * | 4/2019 | Derelov | A47B 47/00 |
| 11,203,877 | B2 | 12/2021 | Ylikangas | |
| 11,359,381 | B2 * | 6/2022 | Sieder | E04F 15/02033 |
| 2003/0101681 | A1 * | 6/2003 | Tychsen | E04F 15/04 52/578 |
| 2004/0200175 | A1 * | 10/2004 | Weber | E04F 15/02 52/592.1 |
| 2006/0260254 | A1 * | 11/2006 | Pervan | E04F 15/02 52/592.1 |
| 2008/0110125 | A1 * | 5/2008 | Pervan | E04F 15/04 52/582.2 |
| 2008/0134613 | A1 * | 6/2008 | Pervan | E04F 15/02 52/582.2 |
| 2008/0134614 | A1 * | 6/2008 | Pervan | E04F 15/02038 52/588.1 |
| 2009/0193748 | A1 * | 8/2009 | Boo | B27F 1/02 408/1 R |
| 2011/0030303 | A1 * | 2/2011 | Pervan | E04F 15/02 83/13 |
| 2011/0167750 | A1 * | 7/2011 | Pervan | E04F 15/02038 52/582.2 |
| 2012/0036804 | A1 * | 2/2012 | Pervan | E04F 13/0894 52/309.1 |
| 2012/0042598 | A1 * | 2/2012 | Vermeulen | E04F 15/02038 52/588.1 |
| 2012/0222378 | A1 * | 9/2012 | Cappelle | E04F 15/02 52/309.1 |
| 2013/0042564 | A1 * | 2/2013 | Pervan | E04F 15/02038 52/582.2 |
| 2013/0263454 | A1 | 10/2013 | Boo | |
| 2013/0333182 | A1 * | 12/2013 | Pervan | E04F 15/02038 29/426.3 |
| 2014/0260060 | A1 | 9/2014 | Boo | |
| 2015/0047284 | A1 * | 2/2015 | Cappelle | E04F 15/02005 52/311.1 |
| 2015/0068151 | A2 | 3/2015 | Pervan et al. | |
| 2015/0330088 | A1 * | 11/2015 | Derelov | E04F 15/02038 52/588.1 |
| 2015/0337542 | A1 * | 11/2015 | Cappelle | E04F 15/10 52/309.1 |
| 2016/0153200 | A1 * | 6/2016 | Pervan | E04F 15/107 52/582.2 |
| 2016/0340913 | A1 * | 11/2016 | Derelov | A47B 47/00 |
| 2017/0037640 | A1 * | 2/2017 | Boucké | E04F 15/107 |
| 2018/0119429 | A1 * | 5/2018 | Schulte | E04F 15/02038 |
| 2018/0305937 | A1 * | 10/2018 | Cappelle | E04F 15/02 |
| 2019/0211568 | A1 * | 7/2019 | Nilsson | E04F 15/0215 |
| 2019/0292793 | A1 * | 9/2019 | Van Vlassenrode | B32B 27/40 |
| 2020/0040589 | A1 | 2/2020 | Loncke et al. | |
| 2020/0173175 | A1 | 6/2020 | Pervan | |
| 2020/0181923 | A1 * | 6/2020 | Quist | E04F 15/02005 |
| 2020/0308846 | A1 | 10/2020 | Josefsson et al. | |
| 2021/0087827 | A1 | 3/2021 | Ylikangas et al. | |
| 2021/0087828 | A1 | 3/2021 | Ylikangas et al. | |
| 2021/0087829 | A1 | 3/2021 | Ylikangas et al. | |
| 2021/0087830 | A1 | 3/2021 | Ylikangas et al. | |
| 2021/0310256 | A1 * | 10/2021 | Boo | E04F 15/02038 |
| 2022/0178150 | A1 | 6/2022 | Ylikangas et al. | |
| 2023/0175260 | A1 * | 6/2023 | Boo | E04C 2/40 52/578 |

OTHER PUBLICATIONS

U.S. Appl. No. 17/029,644, filed Sep. 23, 2020, Roger Ylikangas, Anders Nilsson and Karl Quist (Cited herein as US Patent Applicaiton Publication No. 2021/0087830 A1 of Mar. 25, 2021.

U.S. Appl. No. 17/524,952, filed Nov. 12, 2021, Roger Ylikangas, Anders Nilsson and Karl Quist (Cited herein as US Patent Application Publication No. 2022/0178150 A1 of Jun. 9, 2022).

U.S. Appl. No. 17/642,348, filed Mar. 11, 2022, Roger Ylikangas, Anders Nilsson and Karl Quist.

U.S. Appl. No. 17/709,930, filed Mar. 31, 2022, Christian Boo.

Official Action and Search Report dated Apr. 29, 2021 in SE 2051244-8, PRV, Stockholm, SE, 7 pages.

International Search Report and Written Opinion issued in PCT/SE2021/051019, dated Nov. 24, 2021, Patent-och registreringsverket, Stockholm, SE, 12 pages.

Ylikangas, Roger, et al., U.S. Appl. No. 17/642,348 entitled "Building Panel," filed in the U.S. Patent and Trademark Office filed Mar. 11, 2022.

Boo, Christian, U.S. Appl. No. 17/709,930 entitled "Building Panel and Locking Devices Therefore," filed in the U.S. Patent and Trademark Office filed Mar. 31, 2022.

International Preliminary Report on Patentability received for PCT Patent Application No. PCT/SE2021/051019, dated May 4, 2023, 7 pages.

U.S. Appl. No. 17/642,348, Roger Ylikangas, filed Mar. 11, 2022.

U.S. Appl. No. 18/061,706, Christian Boo, filed Dec. 5, 2022.

U.S. Appl. No. 18/146,602, Roger Ylikangas, filed Dec. 27, 2022.

U.S. Appl. No. 18/383,686, Roger Ylikangas, filed Oct. 25, 2023.

* cited by examiner

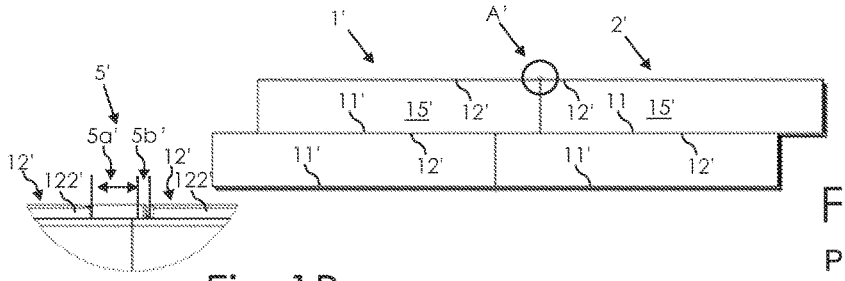
Fig.1A
PRIOR ART
Fig.1B
PRIOR ART
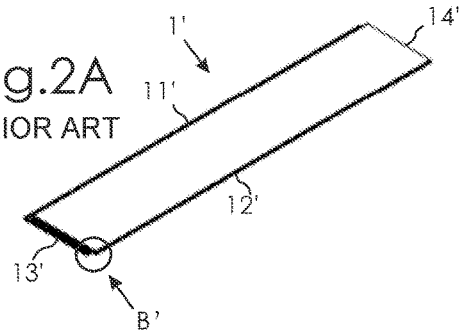
Fig.2A
PRIOR ART
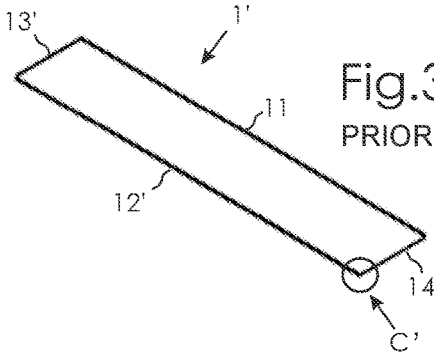
Fig.3A
PRIOR ART
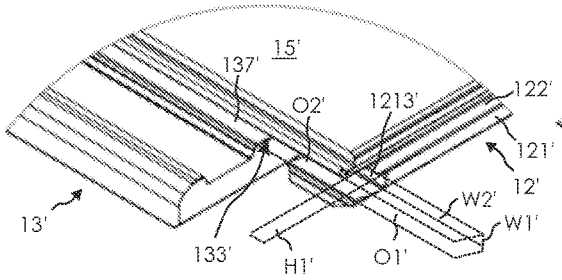
Fig.2B
PRIOR ART
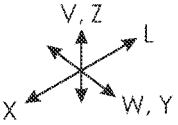
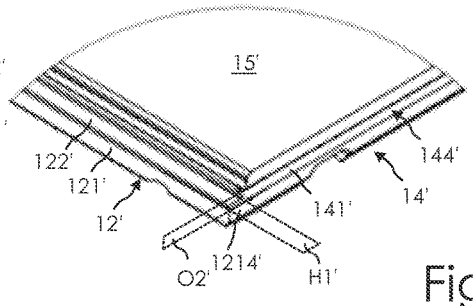
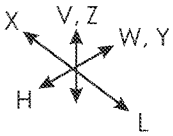
Fig.3B
PRIOR ART

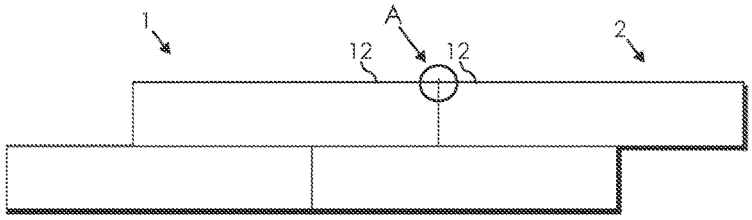
Fig.6A
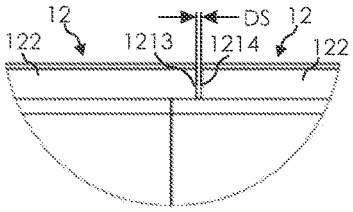
Fig.6B
Fig.7A
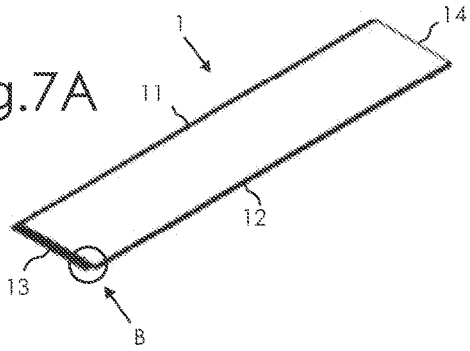
Fig.8A
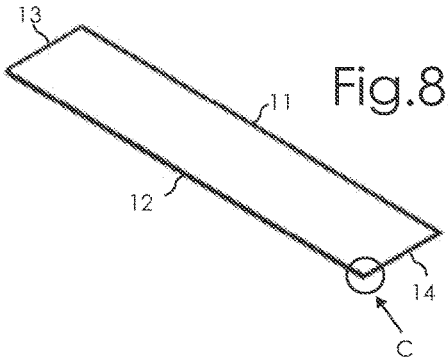
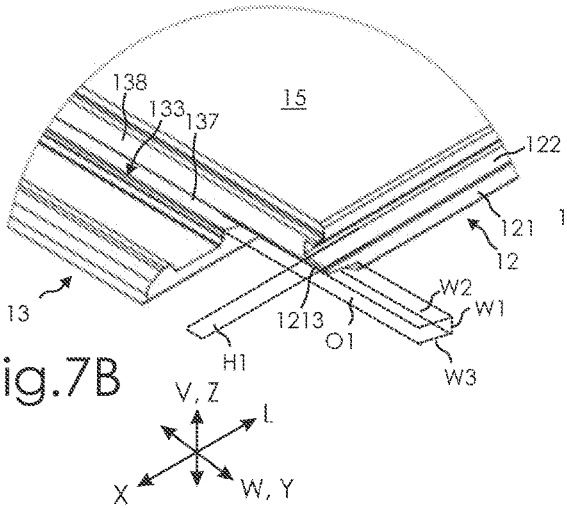
Fig.7B
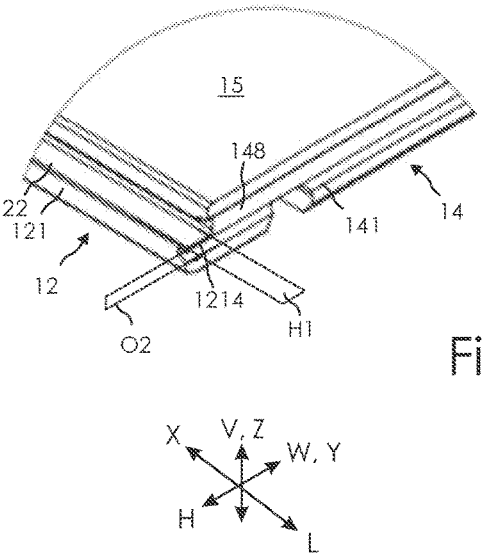
Fig.8B

BUILDING PANEL WITH LOCKING SYSTEM

CROSS REFERENCE TO RELATED APPLICATIONS

The present application claims the benefit of Swedish Application No. 2051244-8, filed on Oct. 23, 2020 and the benefit of Swedish Application No. 2150834-6, filed on Jun. 29, 2021. The entire contents of each of Swedish Application No. 2051244-8 and Swedish Application No. 2150834-6 are hereby incorporated herein by reference in their entirety.

TECHNICAL FIELD

The present disclosure relates to building panels, in particular aspects of the present disclosure relates to locking systems for building panels, more in particular, some aspects of the present disclosure relate to fluid permeability of such locking systems.

BACKGROUND

There are known building panels comprising a first mechanical locking system, typically along opposite long edges, for assembling of adjacent panels in a locked position by means of a folding displacement. There are also known panels comprising a second mechanical locking system, typically along opposite short edges, for assembling adjacent panels in a locked position by means of a vertical displacement curtesy of a displaceable locking tongue.

Although such known panels may represent well-functioning building panels, there is still room for improvements in the technical field.

SUMMARY

It is an object of at least embodiment of the present disclosure to mitigate or at least to some extent alleviate drawbacks of known systems.

In a first aspect, there is provided a building panel, such as a floor panel, comprising a first mechanical locking system at respective first and second opposite edges, such as long edges. The first mechanical locking system comprising at one of the first or second opposite edges a tongue groove configured to receive a locking tongue of the other of the first or second edges, preferably by means of a folding displacement, for vertical locking of adjacent essentially identical panels in an assembled position. The locking tongue comprises an essentially horizontal and preferably upwards-facing upper surface. A second mechanical locking system is formed on respective third and fourth opposite edges, such as short edges. The second mechanical locking system comprises at one of the third or fourth edges a wedge groove configured to receive a displaceable locking tongue, preferably by means of a vertical displacement, such as vertical folding, for vertical locking of essentially identical adjacent panels in an assembled position. The displaceable locking tongue is configured to displace in a displacement groove provided in the other of the third or fourth edge. In one embodiment, the displacement groove comprises an upper wall. The upper wall is preferably arranged vertically below the upper surface of the locking tongue.

In a second aspect, there is provided a set of building panels according to any of the aspects.

These and other aspects, features and advantages of which embodiments of the disclosure are capable of, will be apparent and elucidated from the detailed description.

BRIEF DESCRIPTION OF THE DRAWINGS

These and other aspects, features and advantages of which embodiments of the disclosure are capable of, will be apparent and elucidated from the following description of embodiments of the present disclosure, reference being made to the accompanying drawings, in which FIG. 1A is a top view of a set of assembled panels according to known art.

FIG. 1B shows details A' of FIG. 1A.

FIG. 2A is perspective view of the known panel of FIG. 1A.

FIG. 2B shows details B' of FIG. 2A.

FIG. 3A is another perspective view of the known panel of FIG. 1A.

FIG. 3B shows details C' of FIG. 3A

FIG. 6A is a top view of a set of assembled panels according to an exemplary embodiment of the disclosure.

FIG. 6B shows details A of FIG. 6A.

FIG. 7A is perspective view of the panel of FIG. 6A.

FIG. 7B shows details B of FIG. 7A.

FIG. 8A is another perspective view of the panel of FIG. 6A.

FIG. 8B shows details C of FIG. 8A.

DETAILED DESCRIPTION OF EMBODIMENTS

Figure 4A:
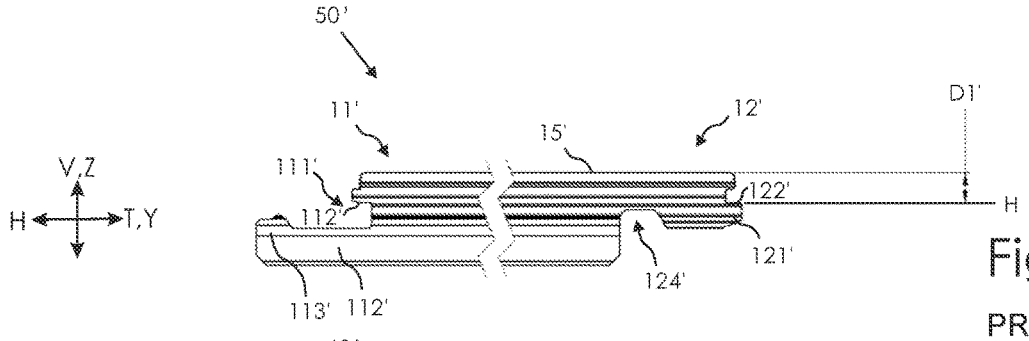
Fig.4A PRIOR ART
FIG. 4A is a cross-sectional view of a first locking system of a known panel.

Specific embodiments of the disclosure will now be described with reference to the accompanying drawings. This disclosure may, however, be embodied in many different forms and should not be construed as limited to the embodiments set forth herein; rather, these embodiments are provided so that this disclosure will be thorough and complete, and will fully convey the scope of the disclosure to those skilled in the art. The terminology used in the detailed description of the embodiments illustrated in the accompanying drawings is not intended to be limiting of the disclosure. In the drawings, like numbers refer to like elements.

FIGS. 1A-1B show a set of known panels 1' assembled in a locked position and arranged with a front surface 15' facing the viewer. FIG. 4A shows details of the known building panel 1'. A first mechanical locking system 50' is formed on respective first edges 11' and second edges 12' of the panels 1', such as long edges, for horizontal and vertical locking of adjacent panels by means of a folding displacement. The second edges 12' comprises a locking tongue 121' configured to be received in a tongue groove 111' by means of the folding displacement, for vertical locking of the panels.

Figure 4B:
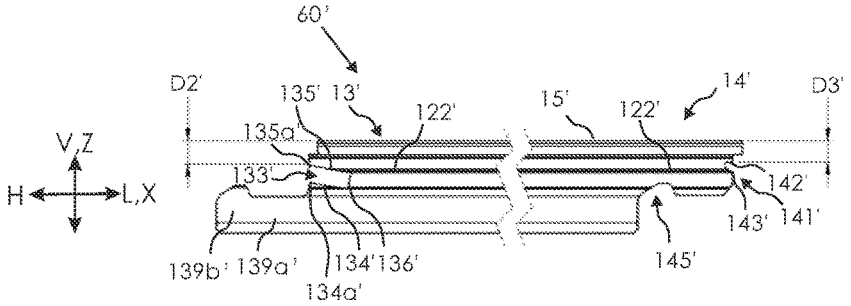
Fig.4B PRIOR ART
FIG. 4B is a cross-sectional view of a second locking system of a known panel.

FIG. 4B shows further details of the known building panel 1'. A second mechanical locking system 60' is formed on respective third 13' edges and fourth 14' edges of the panels 1', such as short edges, for horizontal and vertical locking of adjacent panels by means of a vertical displacement.

The second mechanical locking system 60' may comprise at one of the third or fourth edges 13', 14' a wedge groove 141' configured to receive a displaceable locking tongue 131' of the other of the third or fourth edge 13', 14' for vertical locking of adjacent panels in the assembled position.

The displaceable locking tongue 131' may be configured to displace in a displacement groove 133' of the other of the third or fourth edge 13', 14'. For purpose of more clearly convey the features of the known building panel 1', the displaceable locking tongue 131' has been left out in FIGS. 2B and 4B, which show the known panel 1'.

The displacement groove 133 may be inclined vertically V downwards towards a back surface 16 of the panel 1 or inclined upwards towards the front surface 15 of the panel 1, in a direction into the displacement groove/towards the centre of the panel 1.

As schematically illustrated in FIG. 1B, a spacing 5' is formed in the longitudinal direction of the assembled known panels 1' between the locking tongues 121' of the respective panels when assembled in locking position by means of the second mechanical locking system 60'. The space 5' is formed between a first portion 1213' at a first end of the locking tongue 121' and a second portion 1214' of an opposite second end of the locking tongue 121' of an adjacent panel 2, when the adjacent panels are assembled by means of the second mechanical locking system 60'. The space 5' may typically be about 4.5 mm, or approximately correspond to a size of upper wall 135' of displacement groove 133. The origination of the space 5' may be a consequence of the vertical position of one or more features of the first and/or second locking systems 50', 60', such as the locking tongue 121' and the displacement groove 133'. In particular, the space 5' may be a consequence of the manufacture of such features of the first and/or second locking systems 50', 60'.

In a non-limiting example, the locking systems 50', 60' may be formed by feeding the panel 1' in a feeding direction past one or more cutting tools, such as a rotating cutting tool, whereby the one or more cutting tool may form at least part of a locking system along one of the edges 11', 12', 13', 14'.

Consequently, the first locking system 50' and the second locking system 60' may overlap at respective corners of the panel 1', as shown in FIGS. 2A and 2B. In particular, at least part of the first locking system 50' and the second locking system 60' may intersect at respective corners of the panel 1', as shown in FIGS. 2A and 2B.

Referring to FIGS. 4A-4B, due to the distance D1' between the front surface 15' of the panel to the upper surface 122' of the locking tongue 121' is greater than the distance D2' between the front surface 15' and the upper wall 135' of the displacement groove, such as an uppermost portion of the upper wall 135', the formation of the displacement groove 133', which may involve excising material from the panel to create a void of material, may thus create at a void when it intersects with or crosses the upper surface 122' of the locking tongue 121', such as at the corner B' between the second edge 12' and the third edge 13', as shown in FIG. 2A.

For purpose of conveying the known art, projection H1' schematically illustrates a projection of the upper surface 122' of the locking tongue 121', in the length direction or longitudinal direction L of the panel (i.e., a projection along the upper surface 122').

Projection W2' schematically illustrates a projection of the upper wall 135' of the displacement groove 133', in the width direction or transverse direction T of the panel (i.e., a projection along the upper wall 135').

Projection W1' schematically illustrates a projection of the inner wall 136' of the displacement groove 133', in the width direction or transverse direction T of the panel (i.e., a projection along the inner wall 136').

Projection O1' schematically illustrates a projection of an opening 137' of the displacement groove 133'. The opening 137' is formed by the outermost edge of the upper wall 135 and the outermost edge of the lower wall 134 of the displacement groove 133'.

As derivable, the projection W2' and the projection H1' intersect, which means that a portion of the locking tongue 121' including the upper surface 122' cannot be formed or has been excised during manufacture, thereby, the spacing 5' may be formed. The gap 5' may comprise a first portion 5*a*' and typically a second portion 5*b*' as will be explained herein. Consequently, when adjacent panels are assembled along the short edges, as shown in FIG. 1B, there may be a substantial gap 5' between the upper surface 122' of the respective locking tongues 121' of adjacent panels. Thereby, fluid which migrate from the upper surface 15' to the locking tongue(-s) 121' may penetrate through the joint edges 12' of the first locking system 50', such as when assembled with first edges 11' of adjacent panels. Thereby, fluid may migrate from a front surface 15' to a back surface 16' of the panel, such as under the action of gravity.

In other words, the displacement groove 133', which may be formed by one or more cutting tools, such as rotating cutting tools, and thus constitutes a void of material, such as a core material of the building panel 1', is at least partially formed in the space where the locking tongue 121' of first locking system 50' would otherwise be formed in the core material. In particular, the displacement groove 133' may be at least partially formed in the space where at least a portion of the upper surface 122 of the locking tongue 121' of first locking system 50' would otherwise be formed in the core material.

Projection O2' schematically illustrates a projection of an opening 144' of the wedge groove 141' in the transverse direction T of the panel 1'. The opening 144' is formed by an upper outermost edge 142' and a lower outermost edge 143' of the wedge groove 141'. As derivable, the projection O2' and the projection H1' intersect, which entails that a portion of the locking tongue 121' including a portion of the upper surface 122' cannot be formed due to an absence of material or has been excised during manufacture of the displacement groove. Thereby, a second portion 5*b*' of the gap 5' may be formed. Consequently, when two panels are assembled along the short edges, as shown in FIG. 1B, there may be a formed a second portion 5*b*' of the gap 5' between the respective upper surface 122' of the locking tongues 121' of adjacent panels. Thereby, fluid which migrate from the upper surface 15' to the locking tongue(-s) 121' may penetrate through the joint edges 12' of the first locking system 50', such as when assembled with a first edge 11' of an adjacent third panel (not shown).

Referring again to FIGS. 4A-4B, the distance D1' between the upper surface 15' of the panel 1' and the upper surface 122' of the locking tongue 121' is greater than a distance D3' between the upper surface 15' of the panel 1' and an upper edge 142' of the wedge groove 141'. Consequently, as shown in FIG. 3B, the projection H1' of the upper surface 122' in the longitudinal direction L of the panel 1' intersects at corner C' with the projection O2' of the wedge groove 141' in the transverse direction T of the panel. Wherein corner C' may be a corner between the first locking system 50' of the second edge 12' and the second locking system 60' of the fourth edge 14'. Thereby, at least a portion of the upper surface 122' is excised by the one or more cutting tools (not shown) when the wedge groove 141' is formed.

Thus, from FIG. 2B it can be derived that the upper surface 122' and the upper wall 135' of the displacement groove 133' intersect in a three-dimensional space, such as X, Y, Z.

From FIG. 4B it can again be derived that the upper surface 122' and the upper wall 135' of the displacement groove 133' intersect in a two-dimensional space, such as in the X-Z plane and thus a portion of upper surface 122' is excised by forming the upper wall 135' of the displacement groove 133'.

Thus, from FIG. 3B it can be derived that the upper surface 122' and the wedge groove 141' intersect in a three-dimensional space, such as X, Y, Z.

From FIG. 4B it can again be derived that the upper surface 122' and the wedge groove 141' intersect in a two-dimensional space, such as in the X-Z plane and thus a portion of upper surface 122' is excised by forming the wedge groove 141'.

FIGS. 5A-5B, 6A-6B, 7A-7B, 8A-8B and 9A-9B show embodiments of a panel 1 according to exemplary embodiments of the disclosure.

The panel 1 may be a floor panel, a wall panel, a ceiling panel or a furniture panel.

The panel 1 may comprise a core 3 comprising core material. The core may be a particle board, wood-based, such as wood, HDF, MDF.

The panel 1 may comprise one or more surface layer(-s), such as veneer, a thermosetting adhesive including, not limited to melamine formaldehyde, or combinations thereof. The surface layer(-s) may be provided above and/or below the core 3.

Figure 5A:
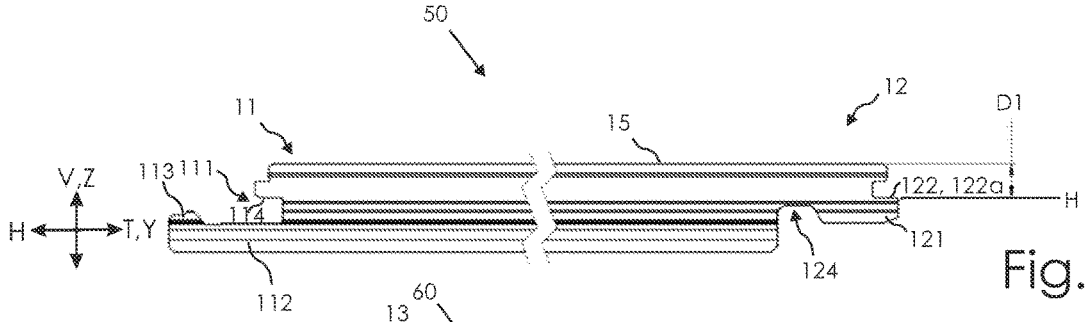
FIG. 5A is a cross-sectional view of a first locking system of a panel according to an exemplary embodiment of the disclosure.
Figure 5B:
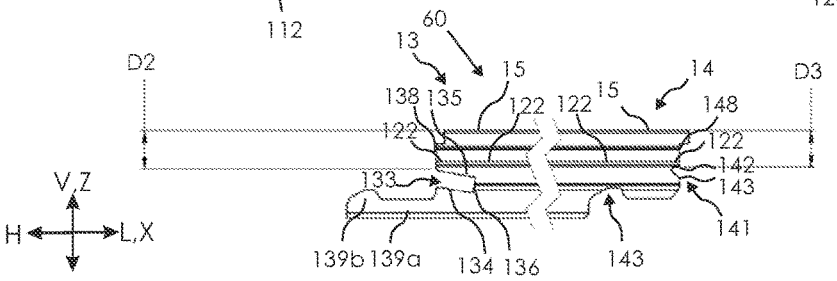
FIG. 5B is a cross-sectional view of a second locking system of a panel according to an exemplary embodiment of the disclosure.

FIG. 5A shows details of a first mechanical locking system 50 according to an embodiment of the disclosure. The first mechanical locking system 50 may be formed on respective first edges 11 and second edges 12 of the panel 1, such as long edges, for horizontal and vertical locking of adjacent panels by means of a folding displacement. FIG. 5B shows details of a second mechanical locking system 60 formed on respective third 13 edges and fourth 14 edges of the panel 1, such as short edges, for horizontal and vertical locking of adjacent panels by means of a vertical displacement.

For purpose of conveying exemplary inventive aspects of the disclosure, the displaceable locking tongue 131 has been omitted in FIGS. 5B and 7B. The displaceable locking tongue 131 is however shown in FIG. 9B.

Referring to FIGS. 5A-5B, curtesy of the distance D2 between the front surface 15 and the upper wall 135 of the displacement groove, such as an uppermost portion of the upper wall 135 is preferably greater than the distance D1, between the front surface 15 of the panel 1 to the upper surface 122 of the locking tongue 121, the formation of the displacement groove 133, which typically involves excising material from the panel to create a void of material, does not create at a void in place of the upper surface 122 of the locking tongue 121 when it intersects with the upper surface 122 of the locking tongue 121, such as at the corner B between the second edge 12 and the third edge 13, as shown in FIG. 7A.

For purpose of conveying exemplary inventive aspects of the disclosure, projection H1 schematically illustrates a projection of the upper surface 122 of the locking tongue 121, such as in the length direction and/or longitudinal direction L of the panel (i.e., a projection along the upper surface 122).

Projection W2 schematically illustrates a projection of the upper wall 135 of the displacement groove 133, such as in the width direction W and/or transverse direction T of the panel 1 (i.e., a projection along the upper wall 135).

Projection W1 schematically illustrates a projection of the inner wall 136 of the displacement groove 133, such as in the width direction W and/or transverse direction T of the panel 1 (i.e., a projection along the inner wall 136).

Projection O1 schematically illustrates a projection an opening 137 of the displacement groove 133 such as in the width direction W or transverse direction T of the panel 1.

The opening 137 is formed by an outermost edge of the upper wall 135 and an outermost edge of the lower wall 134 of the displacement groove 133. As derivable from FIG. 7B, the projection W2 and the projection H1 do not intersect, which entails that a portion of the locking tongue 121 including the upper surface 122 located in a two-dimensional intersection, from a vertical V perspective, between the displacement groove 133 and the upper surface 122 can be formed and/or has not been excised during manufacture of the displacement groove 133. A vertical perspective may be the panel 1 viewed from above, such as facing the front surface 15 thereof. Thereby, the size of the second portion 5*b* of the gap 5 may be reduced or preferably essentially not be formed. Consequently, when two panels 1, 2 are assembled along the short edges 13, 14, as shown in FIG. 6B, the transition between the upper surfaces 122 of the respective panels 1, 2 may contiguous, such as essentially without gap between the upper surface 122 of the respective locking tongues 121 of adjacent panels 1, 2. Thereby, the locking tongue 121, in particular the upper surface 122 of the locking tongue 121, may be provided with a longer extent, such as in the longitudinal direction L, than in the known panel 1'. As shown herein, the upper surface 122 of the locking tongue 121, may be provided with a longer extent than in the known panel 1', such as in the longitudinal direction L, at two opposite end portions thereof.

Thereby, respective locking tongues 121 of adjacent panels 1, 2 may be in contact when configured in assembled position by means of the second mechanical locking system 60.

Thereby, respective upper surfaces 122 of adjacent panels 1, 2 may be essentially contiguous when configured in assembled position by means of the second mechanical locking system 60.

Thereby, fluid which may migrate from the upper surface 15 to the locking tongue(-s) 121, such as under the action of gravity, may be substantially hindered from penetrating through the joint edges 12 of the first locking system 50, such as when assembled with first edges 11 of adjacent panels, as shown in FIGS. 6A-6B.

In other words, the displacement groove 133, which may be formed by one or more rotating cutting tools and is thus void material, such as a core material of the building panel 1, is at least partially formed below the space where the locking tongue 121 of first locking system 50 is formed in the core material, in particular below the upper surface 122 of the locking tongue 121.

FIGS. 6A-6B show a set of panels 1 assembled in a locked position and arranged with a front surface 15 facing the viewer. The front surface 15 may be a front surface of a surface layer 15*a*, such as a decorative surface layer. A corresponding balancing layer 16*a* may be provided on an opposite back side of the panel 1.

Referring to FIGS. 6B, 7B and 8B, the upper surfaces 122 of the respective adjacent panels 1, 2 may advantageously extend essentially contiguous with each other according to the disclosure.

A first end of the locking tongue 121, in the longitudinal direction of the panel 1, may comprise a first portion 1213.

A second end of the locking tongue 121, being opposite the first end of the locking tongue 121, in the longitudinal direction of the panel 1, may comprise a second portion 1214.

The first portion 1213 of the locking tongue 121 may be an outer portion and/or an end-portion of the locking tongue 121, such as an outermost portion of the locking tongue 121, such as an end portion of the locking tongue 121 at the corner between the second edge 12 and the third edge 13. The first portion 1213 may comprise an outermost portion or edge of the upper surface 122.

The first portion 1213 of the locking tongue 121 may comprise a surface, such as an essentially vertical surface. The first portion 1213 may comprise an edge, such as an outermost edge of the locking tongue 121 and/or an outermost edge of the upper surface 122.

The first portion 1213 may comprise a surface and at least one edge.

The second portion 1214 of the locking tongue 121 may be an outer portion and/or an end-portion of the locking tongue 121, such as an outermost portion of the locking tongue 121, such as an end portion of the locking tongue 121 at the corner between the second edge 12 and the fourth edge 14. The second portion 1214 may comprise an outermost portion or edge of the upper surface 122.

The second portion 1214 of the locking tongue 121 may comprise a surface, such as an essentially vertical surface. The second portion 1214 may comprise an edge, such as an outermost edge of the locking tongue 121 and/or an outermost edge of the upper surface 122.

The second portion 1214 may comprise a surface and at least one edge.

The first portion 1213 may comprise a first end portion at a first end of the locking tongue 121, such as in the longitudinal direction L of the panel 1 and/or along the X-axis.

The second portion 1214 may comprise a second end portion at a second opposite end of the locking tongue 121, in the longitudinal direction L of the panel 1 and/or along the X-axis, such as an end portion of the locking tongue of the panel 1 opposite the first end portion of the locking tongue 121 of the panel 1.

The first portion 1213 and the second portion 1214 may in assembled position of adjacent panels 1, 2 be in contact.

The first portion 1213 and the second portion 1214 may in assembled position of adjacent panels 1, 2 be pre-tensioned, such as to press against each other.

The first portion 1213 and the second portion 1214 may be formed in a core material of the panel 1.

The first portion 1213 and the second portion 1214 may in assembled position of adjacent panels 1, 2 be pre-tensioned, such as to press against each other such that a material of the core 3 is deformed.

The first portion 1213 and the second portion 1214 may be configured such that a sufficient size of play DS is obtained in order to ensure that a respective surface layer 15*a* of assembled panels 1, 2 are contiguous and/or not pulled apart.

Referring to FIG. 7B, the first portion 1213 may be configured to be flush with upper portion 138. Upper edge portion 138 may be contiguous with the displacement groove 133.

Referring to FIG. 8B, the second portion 1214 may be configured to be flush with upper portion 148. Upper edge portion 148 may be contiguous with the wedge groove 141.

Fluid may cause the core material 3 to swell, whereby the size of the play DS may shrink.

In some embodiments, such as due to production tolerances, it may be advantageous to design the panel 1 to obtain a minute play DS between the first portion 1213 and the second portion 1214 when the adjacent panels are assembled by means of the second mechanical locking system 60.

In non-limiting example, excessive pretension or pre-tension in combination with a hard core-material may result in that the contact between 1213 and 1214 facilitates that the third and fourth edge of respective adjacent panels 1, 2 are pushed away from each other when said panels 1, 2 are assembled by means of the second locking system 60. As a result, there may be obtained a formed a slot between the surface layers of the panels, which may distort the visual impression of a floor and/or influence the resistance to water penetration negatively.

In any aspect, the size of the play DS may be in the range of 0.00 to +0.50 mm, preferably 0 to +0.30, such as +0.03 to +0.15 mm, more preferably 0.00 to +0.05 mm.

In any aspect, the size of the play DS may be at least partially in a negative range of −0.05 to +0.10 mm. Such range may indicate a certain degree of pre-tension.

The play DS may be adapted based on adapted based on properties of the material of the core 3. The core material may be wood-based, HDF, MDF or like. In particular, the degree of pre-tension may be adapted based on properties relating to hardness of the core-material 3 and/or properties relating to swelling properties of the core-material 3

A degree of pre-tension, i.e., a negative value for DS as discussed above, may be adapted based on properties of the core-material 3. In particular, the degree of pre-tension may be adapted based on properties relating to hardness of the core-material and/or properties relating to swelling properties of the core-material and/or properties relating to deformation of the core-material.

The upper wall 135 and or the lower wall 134 of the displacement groove 133 may be inclined, such as towards a back surface 16 of the panel 1.

In FIG. 8B, projection O2 schematically illustrates a projection of a wedge groove opening 144 in the transverse direction T of the panel 1. The wedge groove opening 144 is formed by an upper outermost edge 142 and a lower outermost edge 143 of the wedge groove 141. As derivable, the projection O2 and the projection H1 do not intersect, which entails that a portion of the locking tongue 121 including the upper surface 122 can be formed or has not been excised when forming the wedge groove 141. Consequently, when two panels are assembled along the short edges, as shown in FIG. 6B, the upper surface 122 of the respective locking tongues 121 of adjacent panels 1, 2 may be essentially contiguous, such as directly contiguous. In other words, thereby respective upper surfaces 122 of adjacent panels 1, 2 may be essentially contiguous when configured in assembled position by means of the second mechanical locking system 60.

Thereby, fluid which migrate from the upper surface 15 to the locking tongue(-s) 121 is substantially hindered from penetrating through the joint edges 12 of the first locking system 50, such as when assembled with first edges 11 of adjacent panels.

Referring, i.a., to FIG. 7B and FIG. 8B, axis X may be a primary axis and the longitudinal- or length-direction of the panel 1 may extend along the X-axis. Axis Y may be a secondary axis and the transverse- or width-direction of the panel 1 may extend along the Y-axis. Axis Z may be a tertiary axis and the thickness direction of the panel 1 may extend along the Z-axis. X, Y and Z may be orthogonal.

Thus, referring to FIG. 7B, the upper surface 122 and the upper wall 135 of the displacement groove 133 do not intersect in a three-dimensional space, such as X, Y, Z.

Referring to FIG. 5B, the upper surface 122 and the upper wall 135 of the displacement groove 133 do not intersect in the two-dimensional space of the X-Z plane and thus the upper wall 135 of the displacement groove 133 may be formed without excising an outermost portion of upper surface 122 at the corner B or, alternatively an outermost portion of the upper surface 122 which overlap the upper wall 135 in the X-Y plane may be formed.

However, from FIG. 7B it may be derived that the upper surface 122 and the upper wall 135 of the displacement groove 133 intersect in the two-dimensional space of X and Y.

Referring to FIG. 8B, the upper surface 122 and the wedge groove 141 do not intersect in the three-dimensional space of X, Y, Z.

However, from FIG. 8B it may be derived that the upper surface 122 and the wedge groove 141 intersect in the two-dimensional space of X and Y.

Referring to FIG. 5B, the upper surface 122 and the wedge groove 141 do not intersect in the two-dimensional space, of the X-Z plane and thus the wedge groove 141 may be formed without excising an outermost portion of the upper surface 122 at corner C or, alternatively an outermost portion of the upper surface 122 which overlap the wedge groove 141 in the X-Y plane may be formed.

The upper wall 135 and the upper surface 122 of the locking tongue 121 may intersect or cross in a two-dimensional space X, Y, yet not in three-dimensional space of X, Y, Z.

Wherein/whereby the wedge groove 141 and the upper surface 122 of the locking tongue 121 may intersect or cross in a two-dimensional space X,Y, yet not in three-dimensional space X, Y, Z.

The displacement groove 133, and preferably wedge groove 141, may be configured such that respective upper surfaces 122 of adjacent panels 1, 2 are essentially contiguous when configured in assembled position by means of the second mechanical locking system 60.

An advantage of embodiments of the disclosure is that a joint system along the long edges, such as the first mechanical locking system 50, may be rendered more resilient to penetration of fluid, such as water.

Referring again to FIGS. 8A-8B, the distance D3 between the upper surface 15 of the panel 1 and an upper and outermost edge 142 of the wedge groove 141 may preferably be greater than distance D1 between the upper surface 15 of the panel 1 and the upper surface 122 of the locking tongue 121. As a consequence, as shown in FIG. 8B, the projection H1 of the upper surface 122 in the longitudinal direction L of the panel 1 may not intersect at corner C with the projection O2 of the wedge groove 141 in the transverse direction T of the panel. Wherein corner C may be a corner between the first locking system 50 of the second edge 12 and the second locking system 60 of the fourth edge 14. Thereby, upper surface 122 of the locking tongue 121 of the first mechanical locking system 50, which may be provided on a long edge of the panel, is not excised by the one or more cutting tools (not shown) configured to form the displacement groove 133 of the second mechanical locking system 60, which may be provided on a short edge of the panel adjacent said long edge.

Distance D1 may be a distance measured between upper surface 15 and the plane of the upper surface 121 and/or the first locking surface 122*a*, such as the shortest distance or perpendicular the upper surface 15.

Distance D2 may be the shortest measured distance perpendicular the upper surface 15 between upper surface 15 and the upper wall 135 of the displacement groove 133. In this exemplary embodiment D2 may be measured perpendicular the upper surface 15 between the upper surface 15 and the outermost edge of the upper wall 135 which together with the outermost edge of the lower wall 134 forms the opening 137 of the displacement groove 137.

An effect of distance D2 being greater than distance D1 is that the displacement groove 133 may be formed completely below the plane of the upper surface 122 of the locking tongue 121 and/or completely below the plane of the first locking surface 122*a* of the locking tongue 121 of the first locking system 50, such as at a corner/intersection B between the second edge 12 and third edge 13.

Figure 9A:
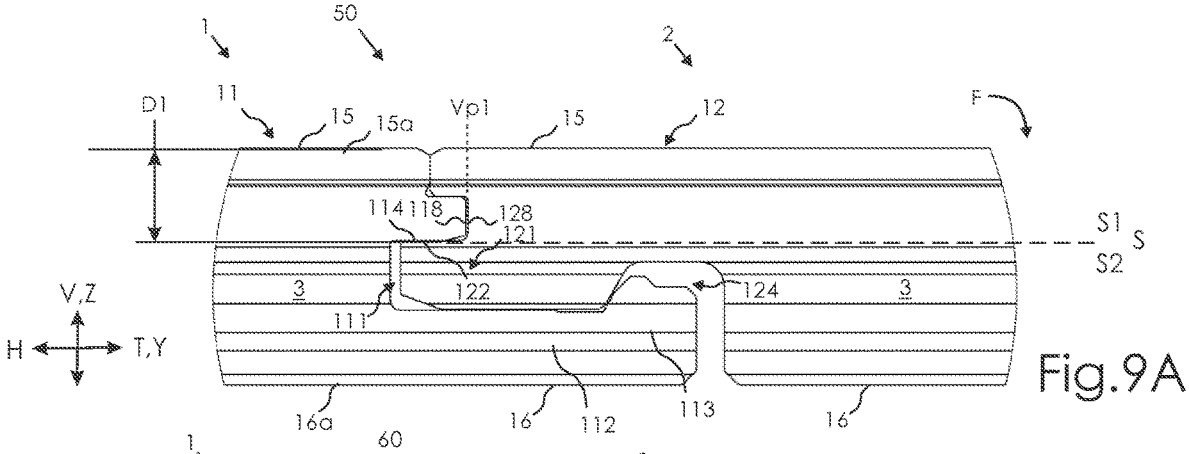
FIG. 9A is a cross-sectional view of a first locking system in assembled position, according to an exemplary embodiment of the disclosure.

Referring to FIG. 9A, immediately juxtaposed upper edge portions 118, 128 of the first 11 of a panel 1 and second edge 12 of an essentially identical adjacent panel 2, may in assembled position of the adjacent panels, form a first vertical plane VP1.

A first locking strip 112 projects from the first edge 11 and from the first vertical plane VP1 and comprises a first locking element 113 configured to be received in a first locking groove 124 of the second edge 12 of the adjacent panel by means of a folding displacement, for horizontal locking of adjacent panels by means of the first mechanical locking system 50.

Figure 9B:
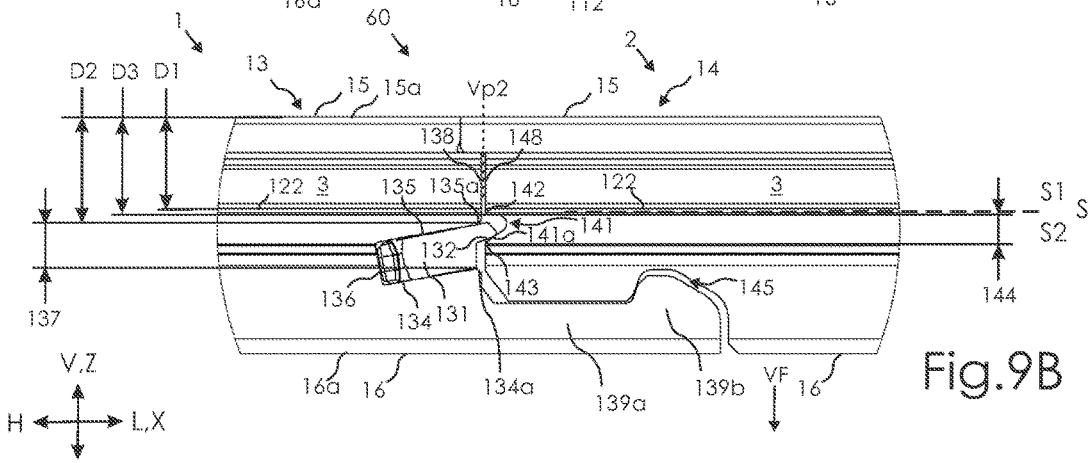
FIG. 9B is a cross-sectional view of a second locking system in assembled position, according to an exemplary embodiment of the disclosure.

Referring to FIG. 9B, immediately juxtaposed upper edge portions 138, 148 of the third 13 edge of a panel 1 and a fourth edge 14 of an adjacent essentially identical panel 2, may in assembled position of the adjacent panels, form a second vertical plane VP2.

A second locking strip 139*a* projects from the second vertical plane VP2 and comprises a second locking element 139*b* configured to be received in the second locking groove 145 of the fourth edge 14 of an adjacent panel by means of a vertical displacement, such as vertical folding of the adjacent panel 2, for horizontal locking of adjacent panels by means of the second mechanical locking system 60.

The upper surface 122 of the locking tongue 121 may extend in the length direction L of the panel to the upper edge portion 138 forming the vertical plane VP.

Figure 10A:
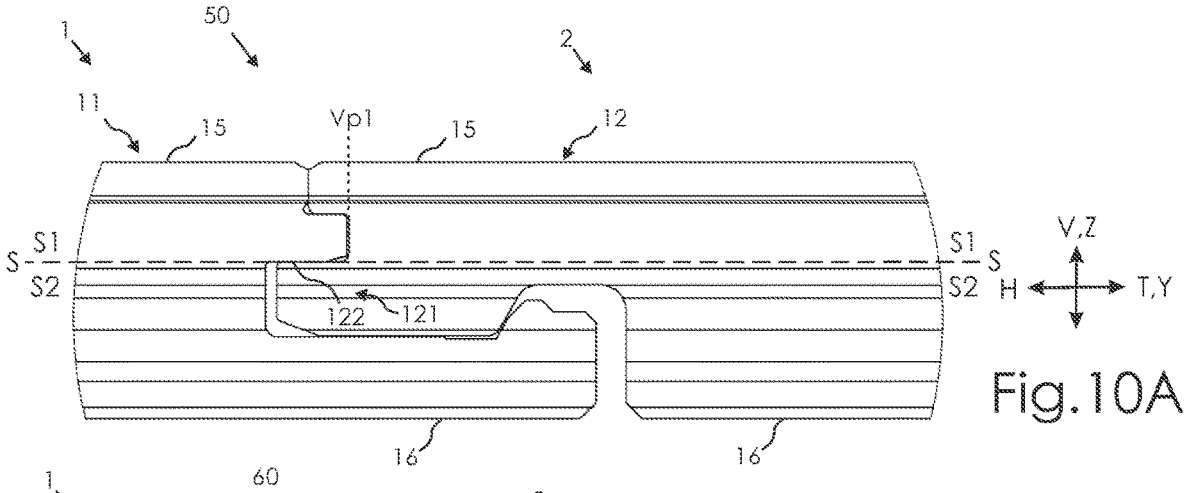
FIG. 10A is a cross-sectional view of a first locking system in assembled position, according to an exemplary embodiment of the disclosure.
Figure 10B:
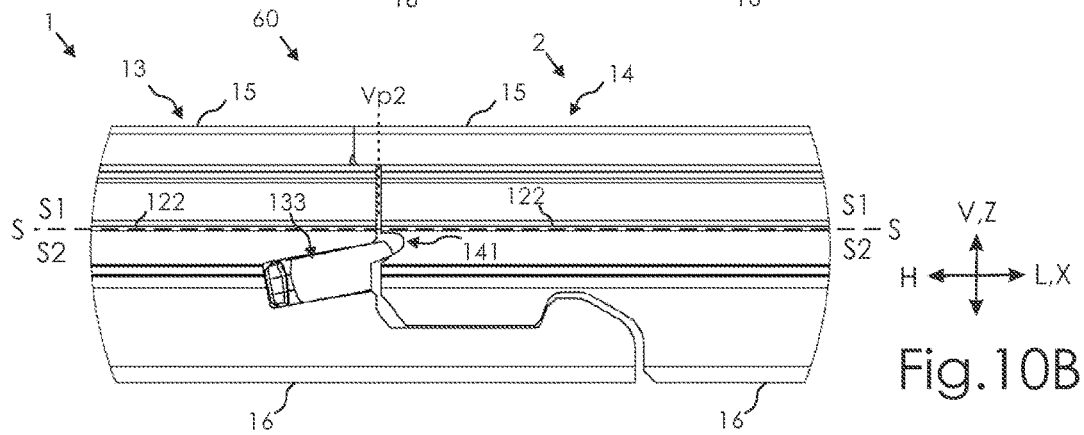
FIG. 10B is a cross-sectional view of a second locking system in assembled position, according to an exemplary embodiment of the disclosure.

Now referring to FIGS. 10A-10B, there is again shown a first mechanical locking system 50 of a panel 1 in FIG. 10A and a second mechanical locking system 60 of the panel 1 in FIG. 10B. The embodiment of FIG. 10A may comprise all the features of the embodiment of FIG. 9A and the embodiment of FIG. 10B may comprise all the features of the embodiment shown in FIG. 9B, however for clarity, some references have been left out.

The panel 1 may comprise a plane S, such a plane extending parallel the front surface 15 and/or back surface 16 of the panel 1. The plane S may be a horizontal H plane.

In one aspect, the upper surface 122 of the locking tongue 121 may be disposed on a first side S1 of the plane S and the displacement groove 133, and preferably the wedge groove 141, is disposed on a second side S2 of the plane S, wherein the second side S2 is an opposite side of the first side S1.

Preferably, the entire upper surface 122 of the locking tongue 121 may be disposed on a first side S1 of the plane S and the entire displacement groove 133, and preferably the entire wedge groove 141, is disposed on a second side S2 of the plane S.

The first side S1 of the plane S, may extend from the plane S towards the front surface 15 of the panel 1 and/or face towards the front surface 15 of the panel 1. The first side S1 may comprise an upper portion of the panel 1. The second side S2 of the plane S, may extend from the plane S towards the back surface 16 of the panel 1 and/or face towards the back surface 16 of the panel 1. The second side S2 may comprise a lower portion of the panel 1.

Items

ITEM 1. A set of building panels 1, such as a floor panel, comprising a first mechanical locking system 50 at respective first and second opposite edges 11, 12, such as long edges, the first mechanical locking system 50 comprising at one of the first or second opposite edges a tongue groove 111 configured to receive a locking tongue 121 of the other of the first or second edges, preferably by means of a folding displacement F, for vertical locking of adjacent essentially identical panels 1, 2 in an assembled position, said locking tongue comprising an essentially horizontal and/or upwards-facing upper surface 122; and a second mechanical locking system 60 on respective third and fourth opposite edges 13, 14, such as short edges, the second mechanical locking system comprising at one of the third or fourth edges a wedge groove 141 configured to receive a displaceable locking tongue 131, preferably by means of a vertical displacement V, such as vertical folding VF, for vertical locking of essentially identical adjacent panels 1, 2 in an assembled position, wherein said displaceable locking tongue 131 is configured to displace in a displacement groove 133 provided in said other of the third or fourth edge.

ITEM 2. The set according to item 1, wherein said displacement groove comprising an upper wall 135, wherein the upper wall 135 is arranged vertically V below the upper surface 122 of the locking tongue 121.

ITEM 3. The set according to item 1 or 2, wherein the entire upper wall 135 is arranged vertically V below the upper surface 122 of the locking tongue 121.

ITEM 4. The set according to any one of the preceding items 1 to 3, wherein the displacement groove 133 comprises a sideways open opening 137, such as in a longitudinal L direction, wherein the opening 137, preferably the entire opening 137, is provided vertically V below the upper surface 122 of the locking tongue 121.

ITEM 5. The set according to any one of the preceding items 1 to 4, wherein said wedge groove 141 is arranged vertically V below the upper surface 122 of the locking tongue 121, preferably an upper and outermost edge 142 of the wedge groove 141 is arranged vertically V below the upper surface 122 of the locking tongue 121.

ITEM 6. The set according to any one of the preceding items 1 to 5, wherein said upper surface 122 comprises a first locking surface 122*a*, preferably facing in an essentially vertical V direction, said first locking surface 122*a* configured to cooperate with a second locking surface 114 provided by the respective tongue groove 111 of an adjacent panel 2 for vertical locking of adjacent panels in an assembled position by means of said folding displacement.

ITEM 7. The set according to any one of the preceding items 1 to 6, wherein a third locking surface 141*a* is provided by the wedge groove 141 and is configured to cooperate with a fourth locking surface 132 provided by the displaceable tongue 131 of an adjacent panel 2 for vertical locking of the third and fourth edges of respective panels 1, 2.

ITEM 8. The set according to any one of the preceding items 1 to 7, wherein the inner wall 136 is provided at least partially below the opening 137 of the displacement groove 133.

ITEM 9. The set according to any one of the preceding items 1 to 8, wherein the displacement groove 133 is sideways open in a direction away from the third edge 13 and comprises an opening 137, said opening 137 formed by an outermost edge 135*a* of the upper wall 135 and an outermost edge 134*a* of the lower wall 134, wherein the upper surface 122 of the locking tongue 121 is provided vertically V above the outermost edge 135*a* of the upper wall 135.

ITEM 10. The set according to any one of the preceding items 1 to 9, wherein immediately juxtaposed upper edge portions 138, 148 of the third 13 and fourth edge 14, in assembled position of two adjacent panels 1, 2, form a second vertical plane VP2, wherein the upper surface 122 of the locking tongue 121 extends in the length direction L of the panel to the upper edge portion 138 forming the vertical plane VP.

ITEM 11. The set according to any one of the preceding items 1 to 10, wherein immediately juxtaposed upper edge portions 138, 148 of the third 13 and fourth edge 14, in assembled position of two adjacent panels 1, 2, form a second vertical plane VP2, wherein the upper surface 122 of the locking tongue 121 extends in the length direction L of the panel to the upper edge portion 148 forming the vertical plane VP.

ITEM 12. The set according to any one of the preceding items 1 to 11, wherein the upper surface 122 of the locking tongue 121 extends in the longitudinal direction L of the panel to the opening 137 of the displacement groove 133.

ITEM 13. The set according to any one of the preceding items 1 to 12, wherein the panel 1 comprises a surface layer, such as a decorative surface layer, wherein the upper surface 122 of the locking tongue 121 extends at least along the entire upper surface layer of the panel 1 at the corner B between the second edge 12 and the third edge 13.

ITEM 14. The set according to any one of the preceding items 1 to 13, wherein the panel 1 comprises a surface layer, such as a decorative surface layer, wherein the upper surface 122 of the locking tongue 121 extends essentially along the entire upper surface layer of the panel 1 at the corner C between the second edge 12 and the fourth edge 14.

ITEM 15. The set according to any one of the preceding items 1 to 14, wherein the first mechanical locking system 50 and the second mechanical locking system 60 are formed at least partially by means of cutting tools, such as rotating cutting tools.

ITEM 16. The set according to any one of the preceding items 1 to 15, wherein said displacement groove 133 comprises an inner wall 135 and a lower wall 134, wherein the lower wall 134 and the upper wall 135 extends essentially parallel on opposite sides of the upper wall 135.

ITEM 17. The set according to any one of the preceding items 1 to 16, wherein said displacement groove 133 is sideways open and extends from the opening 137 into the panel 1, such as in a longitudinal direction L, towards a centre of the panel 1, wherein the inner wall 135 is formed closest to the centre of the panel 1.

ITEM 18. The set according to any one of the preceding items 1 to 17, wherein a first end of the locking tongue 121, in the longitudinal direction L of the panel 1, comprises a first portion 1213, and a second opposite end of the locking tongue 121, being opposite the first end of the locking tongue 121, in the longitudinal direction of the panel 1, comprises a second portion 1214.

ITEM 19. The set according to the preceding item 18, wherein said first portion 1213 and said second portion 1214 are configured to, in assembled position of adjacent panels 1, 2, essentially be in contact, or in contact.

ITEM 20. The set according to any one of the preceding items 18 to 19, wherein the first portion 1213 and the second portion 1214 are configured such that, in assembled position of adjacent panels 1, 2, the first and second portion 1213, 1214 are pre-tensioned against each other, such as to press against each other or be press-fitted against each other.

ITEM 21. The set according to any one of the preceding items 18 to 20, wherein the first portion 1213 and the second portion 1214 are configured such that, in assembled position of adjacent panels 1, 2 by means of the second mechanical locking system 60, a play DS is formed there between, wherein the first portion 1213 and the second portion 1214 are configured such that a sufficient size of a play DS therebetween is obtained such that a respective surface layer 15*a* of assembled panels 1, 2 are contiguous and/or not pushed apart.

ITEM 22. The set according to any one of the preceding items 18 to 21, wherein immediately juxtaposed upper edge portions 138, 148 of the third 13 and fourth edge 14, in assembled position of two adjacent panels 1, 2, form a second vertical plane VP2, wherein the first portion 1213 is configured to be flush with said upper edge portion 138 of the third edge 13, preferably said second portion 1214 is configured to be flush with said upper edge portion 148 of the fourth edge 14.

ITEM 23. The set according to any one of the preceding items 18 to 22, wherein the first portion 1213 and the second portion 1214 are configured such that, in assembled position of adjacent panels 1, 2 by means of the second mechanical locking system 60, a play DS is formed there between, wherein the play DS is in the range of 0.00 to +0.5 mm, preferably 0.00 to +0.3 mm, such as 0.03 to 0.15, more preferably 0.00 to +0.05 mm.

ITEM 24. The set according to any one of the preceding items 18 to 22, wherein the first portion 1213 and the second portion 1214 are configured such that, in assembled position of adjacent panels 1, 2 by means of the second mechanical locking system 60, a play DS is formed there between, wherein the play DS is in the range of −0.05 to +0.10 mm.

ITEM 25. The set according to any one of the preceding items 18 to 24, wherein, the panel 1 comprises a plane S, such a plane extending parallel the front surface 15 of the panel 1, wherein the upper surface 122 of the locking tongue 121 is disposed on a first side S1 of the plane S and the displacement groove 133, and preferably the wedge groove 141, are disposed on a second side S2 of the plane S, wherein the second side S2 is a side of the plane S being opposite the first side S1.

ITEM 26. The set according to item 1, wherein the panel 1 is configured such that a play DS according to any of items 19, 21 or 23 is obtained.

ITEM 27. The set according to the preceding item, wherein configuring the panel 1 comprises configuring a position of at least one of the displacement groove 133 or the wedge groove 141 or the upper surface 122 of the locking tongue 121.

ITEM 28. The set according to the preceding item, wherein configuring a position comprises configuring a vertical (V) position.

ITEM 29. The set of building panels 1 according to any preceding item, wherein the panels are essentially identical building panels.

The invention claimed is:

1. A set of building panels, comprising:

a first mechanical locking system at respective first and second opposite edges, the first mechanical locking system comprising at one of the first or second opposite edges a tongue groove configured to receive a locking tongue of the other of the first or second edges by a folding displacement of the locking tongue for vertical locking of adjacent essentially identical panels in an assembled position, said locking tongue comprising an essentially horizontal and/or upwards-facing upper surface, the first mechanical locking system further comprising at one of the first or second opposite edges a locking groove configured to receive a locking element of a locking strip projecting from the other of the first or second edges by a folding displacement; and a second mechanical locking system on respective third and fourth opposite edges, the second mechanical locking system comprising at one of the third or fourth edges a wedge groove configured to receive a displaceable locking tongue by a vertical displacement of the wedge groove, for vertical locking of essentially identical adjacent panels in an assembled position, wherein said displaceable locking tongue is configured to be displaced in a displacement groove provided in said other of the third or fourth edge, the other of the third or fourth edge having a horizontally outermost end toward the third or fourth edge, an entirety of said displacement groove being horizontally offset from the horizontally outermost end of the other of the third or fourth edge, said displacement groove comprising an upper wall, wherein the upper wall of the displacement groove is arranged vertically below the upper surface of the locking tongue.

2. The set according to claim 1, wherein the entire upper wall is arranged vertically below the upper surface of the locking tongue.

3. The set according to claim 1, wherein the displacement groove comprises a sideways open opening, wherein the opening is provided vertically below the upper surface of the locking tongue.

4. The set according to claim 1, wherein said wedge groove is arranged vertically below the upper surface of the locking tongue.

5. The set according to claim 1, wherein a first end of the locking tongue, in the longitudinal direction of the panel, comprises a first portion, and a second opposite end of the locking tongue comprises a second portion.

6. The set according to claim 5, wherein said first portion and said second portion are configured to, in assembled position of adjacent panels, essentially be in contact, or in contact.

7. The set according to claim 5, wherein the first portion and the second portion are configured such that, in assembled position of adjacent panels, the first and second portion are pre-tensioned against each other.

8. The set according to claim 5, wherein the first portion and the second portion are configured such that, in assembled position of adjacent panels by the second mechanical locking system, a play is formed between the adjacent panels, wherein the first portion and the second portion are configured such that a sufficient size of the play is obtained such that respective surface layers of the assembled adjacent panels are contiguous and/or not pushed apart.

9. The set according to claim 5, wherein immediately juxtaposed upper edge portions of the third and fourth edge, in assembled position of two adjacent panels, form a second vertical plane, wherein the first portion is configured to be flush with said upper edge portion of the third edge.

10. The set according to claim 5, wherein the first portion and the second portion are configured such that, in assembled position of adjacent panels by the second mechanical locking system, a play is formed between the adjacent panels, wherein the play is in the range of 0.00 to +0.50 mm.

11. The set according to claim 5, wherein the first portion and the second portion are configured such that, in assembled position of adjacent panels by the second mechanical locking system, a play DS is formed between the adjacent panels wherein the play DS is in the range of −0.05 to +0.10 mm.

12. The set according to claim 1, wherein the panel comprises a plane, wherein the upper surface of the locking tongue is disposed on a first side of the plane, and wherein the displacement groove is disposed on a second side of the plane, wherein the second side is a side of the plane being opposite the first side.

13. The set according to claim 1, wherein the locking strip is arranged at one of the first or second edges and the locking tongue is arranged at the other of the first or second edges.

14. The set according to claim 1, wherein the locking strip is arranged vertically below the locking tongue.

15. The set according to claim 1, wherein the horizontally outermost end of the other of the third or fourth edge is located at a second locking strip of the other of the third or fourth edge, the second locking strip including a locking element configured to be received by a lower locking groove of the third or fourth edge, the second locking strip being free of the displacement groove.

* * * * *